US012538971B2

(12) United States Patent
Morrow

(10) Patent No.: US 12,538,971 B2
(45) Date of Patent: Feb. 3, 2026

(54) LARGE VOLUME PERSONAL CARE PRODUCT DISPENSER

(71) Applicant: Richard P. Morrow, Norwalk, CT (US)

(72) Inventor: Richard P. Morrow, Norwalk, CT (US)

( * ) Notice: Subject to any disclaimer, the term of this patent is extended or adjusted under 35 U.S.C. 154(b) by 0 days.

(21) Appl. No.: 18/751,217

(22) Filed: Jun. 22, 2024

(65) Prior Publication Data

US 2024/0341448 A1 Oct. 17, 2024

Related U.S. Application Data

(63) Continuation of application No. 17/572,553, filed on Jan. 10, 2022, now Pat. No. 12,016,446, which is a continuation of application No. 16/719,736, filed on Dec. 18, 2019, now Pat. No. 11,219,295.

(51) Int. Cl.
*A45D 40/00* (2006.01)
*A45D 40/26* (2006.01)

(52) U.S. Cl.
CPC ..... *A45D 40/261* (2013.01); *A45D 40/0087* (2013.01); *A45D 40/26* (2013.01); *A45D 40/00* (2013.01)

(58) Field of Classification Search
CPC .... A45D 40/26; A45D 40/087; A45D 40/081; A45D 40/00; A45D 40/12; A45D 40/18; A45D 40/22; A45D 40/221; A45D 40/222; A45D 2040/0006; A45D 2040/0012; A45D 2040/0025; A45D 2040/22; A45D 40/0087; A45D 40/261
USPC ..... 401/58, 59, 62, 86, 87, 98; 215/270, 215/317, 321, 31, 353
See application file for complete search history.

(56) References Cited

U.S. PATENT DOCUMENTS

| | | | | |
|---|---|---|---|---|
| 3,131,410 A * | 5/1964 | Anderson | A47L 23/05 | 206/229 |
| 5,615,440 A * | 4/1997 | Cowan | A47L 23/05 | 604/289 |
| 5,738,123 A * | 4/1998 | Szekely | A45D 40/16 | 401/98 |
| 8,444,337 B2 * | 5/2013 | Teller | A61K 8/925 | 206/385 |
| 9,924,776 B2 * | 3/2018 | Schlatter | A45D 40/00 | |

* cited by examiner

*Primary Examiner* — David J Walczak
(74) *Attorney, Agent, or Firm* — Anthony H. Handal; Handal & Morofsky LLC

(57) ABSTRACT

A device for receiving, molding, cooling, and dispensing a molten product for skin application. It includes a base with a top surface for holding the solidified product and a mold frame member secured to the base, forming a mold with the top surface to receive the molten material. A closure member mates with the mold frame to form a cap, using locking structures for secure closure. The base and cover have rotary engagement structures like screw threads or bayonets. The device also features radial members for even distribution of the molten material.

21 Claims, 16 Drawing Sheets

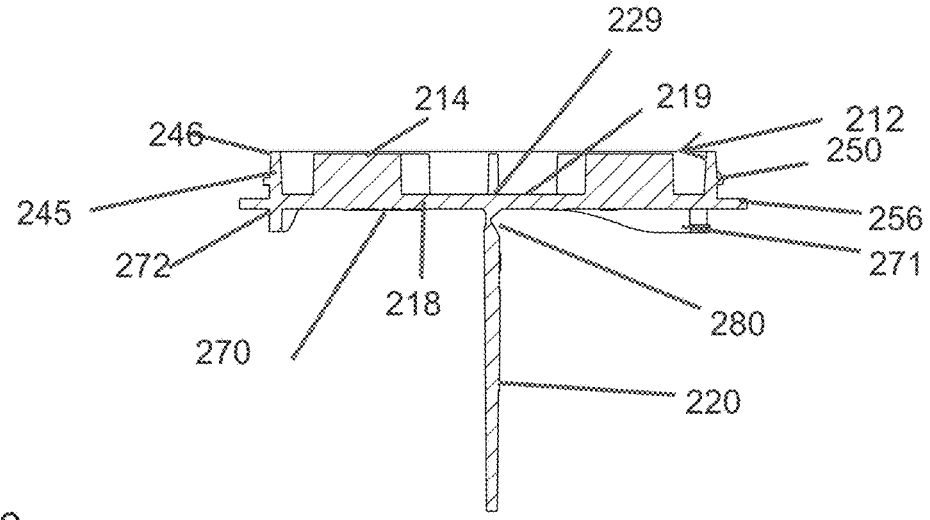
Fig. 20
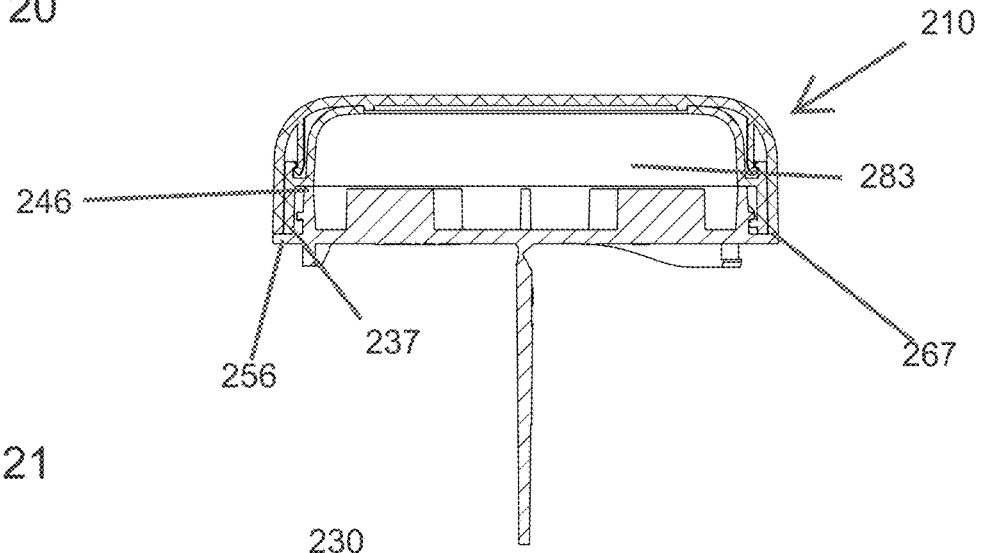
Fig. 21
Fig. 22
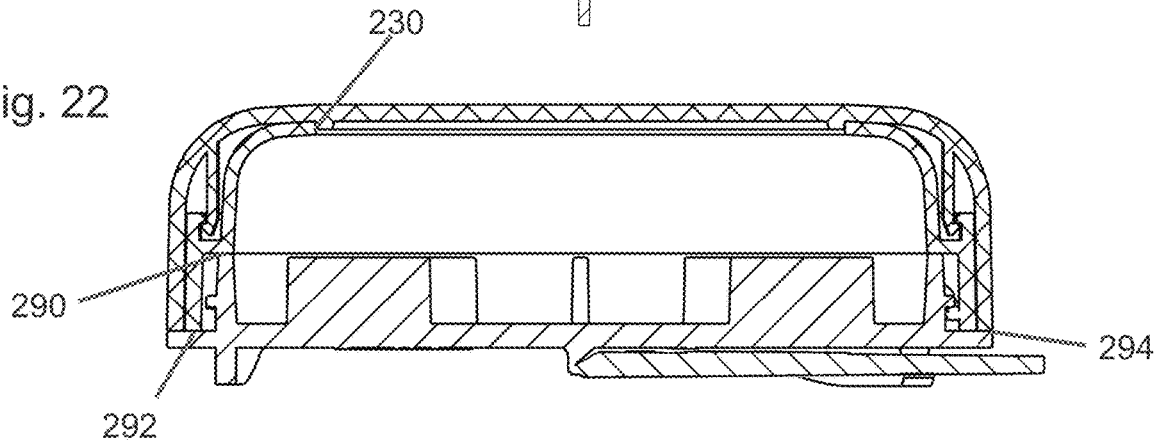

LARGE VOLUME PERSONAL CARE PRODUCT DISPENSER

TECHNICAL FIELD

The invention relates to apparatus and methods for the delivery of deodorant to the surface of the skin of a human user.

CROSS REFERENCE TO RELATED APPLICATIONS

This application claims priority to and is a Continuation-In-Part of U.S. patent application Ser. No. 17/572,553, filed on Jan. 10, 2022, titled "Large Volume Personal Care Product Dispenser" which is incorporated herein by reference, and U.S. patent application Ser. No. 16/719,736 filed on Dec. 18, 2019, titled "Travel Size Deodorant Dispenser with Improved Cap, the contents of which are hereby incorporated by reference.

BACKGROUND OF THE INVENTION

Today, people are exceedingly busy in attending to business matters and often have to rush between multiple appointments. Often, this does not leave much time for the luxury of returning home to freshen up. Accordingly, such products are of increasing importance.

Additionally, a high-paced, mobile lifestyle, involving such things as airline flights, road trips and the like, does not lend itself well to carrying large hygiene product containers, such as a conventional deodorant product, which can open, and under certain circumstances, spill while they are inside bags and briefcases. Therefore, a need exists for a small, single use deodorant applicator which can be easily concealed, even in a small pocket, yet safe for transport due to an individually sealed, portable design.

SUMMARY OF THE INVENTION

In accordance with the invention, as described herein is a device for receiving a molten product for application to the skin, molding the shape of the product and containing it while it cools and solidifies, and then serve as a dispenser for the cooled and solidified product. The device comprises a base that supports the product in its solid state, and features a top surface for holding the product and an outer peripheral surface for stability. A mold frame member is secured to the base, forming a mold with the base's top surface to receive the molten material. The mold frame member also has an outer peripheral surface that aligns with the base. A closure member configured to mate with the mold frame member, and together they form a cap. This closure member includes a locking structure that interacts with a corresponding structure on the mold frame member to ensure a secure closure. The base has a first rotary engagement structure on its outer peripheral surface, and the cover has a mating rotary engagement structure on its inner peripheral surface, allowing for secure attachment. These engagement structures can be either screw threads or bayonet mechanisms. Additionally, the device features a top closure member and a circumferential sidewall that attaches to the closure member, providing an internal surface for added security. Radial members extend perpendicularly from the base's top surface, creating channels for the molten material to flow through, which helps in evenly distributing the material within the mold. Variations in the rotary engagement structures include either screw threads or bayonets or other suitable engagement structures, for example, snap-fit fasteners, clips and clamps, magnets, hinges and latches, hook and loop fasteners, pressure fittings, adhesives, quarter-turn fasteners, interference fits, slide locks, and non-rotatory engagement structures offering different methods of securing the cover to the base.

Another aspect of this invention relates to an apparatus designed for applying personal hygiene or other topically applied substances to the skin. The apparatus consists of a base with an applicator portion that has a surface for supporting the topically applied substance. This substance, which can be personal hygiene products or other topical applications, is securely attached to the support surface, forming an applicator with the base. The apparatus includes a protective member that forms a closed compartment to house and protect the topically applied substance, ensuring it remains clean and ready for use. The apparatus features a fill frame and cover that work together to define the shape and volume of the substance. The fill frame has an upper opening and internal threads, and the base has external threads, allowing the fill frame to be securely attached for filling. The cover is then secured to the fill frame, closing the opening and forming a protective member. Semi-permanent attachment mechanisms such as prongs and sockets secure the cover to the fill frame, ensuring a locked protective member. In an alternate embodiment, alternative attachment mechanisms can be used such as adhesives, hot melt adhesive, ultrasonic welding, hot plate welding, vibration welding, spin welding, infrared welding, solvent bonding, snap fit, thermal bonding, chemical welding, rivets, press fittings, solder, crimping, heat staking, or other suitable attachment mechanisms. A detent tab or nub on the fill frame threads interacts with a click member and stop member on the base. When the fill frame is rotated to secure it to the base, the detent tab produces an audible click and interacts with the stop member to indicate that the attachment is secure. A circumferential shoulder on the base aligns with the protective member, forming a flush seal that substantially prevents air or liquid leakage in or out of the inner volume.

Some additional aspects may include but are not limited to: Six sets of prongs and sockets on the fill frame and cover ensure a secure attachment. Raised radial members on the applicator portion allow the molten substance to flow outwardly towards the support surface's outer portion without obstruction. A gripping portion is attached or integrated with the applicator portion, enhancing ease of use. This gripping portion may include a handle that can be pivotally mounted to the applicator portion. The handle includes an engagement member with a set of teeth for secure attachment when retracted. A support member on the base, with a height matching the engagement member, adds stability. A tab on the gripping portion may include a hole for additional functionality. A living hinge on the gripping portion provides flexibility and ease of use.

BRIEF DESCRIPTION OF THE DRAWINGS

The operation of the inventive will become apparent from the following description taken in conjunction with the drawings, in which:

FIG. 20 shows a cross sectional side view of the applicator.

FIG. 21 shows a cross sectional side view of the applicator and cover combination.

FIG. 22 shows a cross sectional side view of the dispenser with the handle folded.

DETAILED DESCRIPTION OF THE PREFERRED EMBODIMENTS

Figure 1:
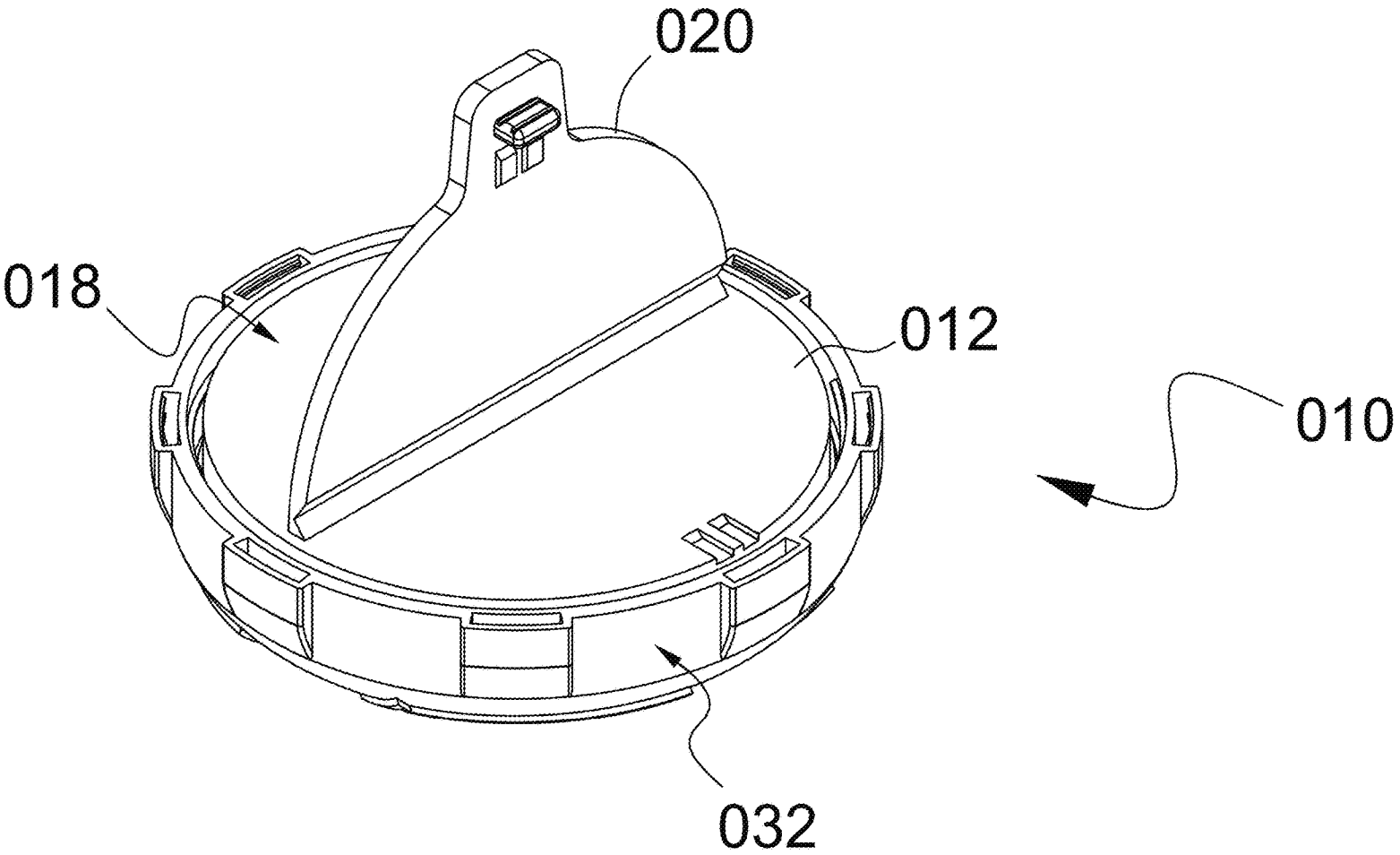
FIG. 1 is an isometric bottom view of a living hinge embodiment of the deodorant dispenser of the present invention closed with a cap and with a handle in a use position attached to the base.

Referring to FIG. 1, an embodiment of the invention is illustrated. A single-use deodorant dispenser 10 comprises a polymeric plastic material in accordance with this embodiment of the invention. Alternatively, other materials may be used, such as polymeric composites, for example composites incorporating fibers such as graphite or fiberglass, or metal.

Deodorant dispenser 10 comprises an applicator 18 and a cap 32. Applicator 18 and cap 32 together form a container for containing the material to be dispensed, such as deodorant, sunscreen, antibiotic, anesthetic, poison ivy treating, bug repellent, antihistamine, skin moisturizer, cortisone, or allergic reaction treating materials.

The material being applied by dispenser 10 is contained within dispenser 10, having been deposited therein as is detailed below. The applicator 18 comprises a rigid base 12 which functions as a foundation upon which the rest of the device is constructed and a handle 20 attached to applicator base 12. In accordance with the present invention, half disc-shaped gripping portion of handle 20, together with handle base 11 and living hinge portion 22 are manufactured as a separate part, for example by injection molding plastic into a mold. Handle base 11 is secured to the underside 23 of applicator base 12.

During use, the user rotates handle 20 angularly from the flat position (FIG. 3) to the position illustrated in FIG. 1. Cap 32 is then unscrewed and removed to expose the material to be applied, allowing use of the material by application to, for example, the skin, by the user holding extended out handle 20 while smearing the material onto the skin. The user, after application, places cap 32 onto applicator base 18 and rotates cap 32 in the clockwise direction to seal it onto applicator base 12, protecting the material until the next use.

Base 12 is disc-shaped and its diameter can vary between 12 and 110 millimeters and its thickness 13 (FIG. 5) may vary typically from 1 to 2 mm, or it may have any thickness sufficient to result in substantial rigidity of the base in its role of supporting the material being dispensed (for example deodorant or sunscreen). Base 12 must stably support the material being dispensed during application to the skin.

In accordance with the preferred embodiment, the base has a diameter ranging between 12 mm and 110 mm. The material receiving volume must be sufficient to receive the material being dispensed with an average thickness 46 ranging between 1 mm and 14 mm. More preferably the base has a diameter ranging between 20 mm and 80 mm with a material receiving volume having an average thickness 46 ranging between 2 mm and 10 mm. Most preferably, the base has a diameter ranging between 25 mm and 60 mm with a material receiving volume having an average thickness 46 ranging between 3 mm and 8 mm, or perhaps ideally between 4 and 6 mm.

In accordance with the invention, it is contemplated that deodorant dispenser 10 has an internal volume 48 (FIG. 4), which comprises a volume 51 (which houses the actual material being applied) (FIG. 5) located above arcuate walls 14 which receives the material to be dispensed and has an average thickness 46. Internal volume 48 further comprises an additional volume 53 which is defined in between arcuate walls 14, which holds material which provides a support function for the material (located above the arcuate walls 14) being applied.

Figure 2:
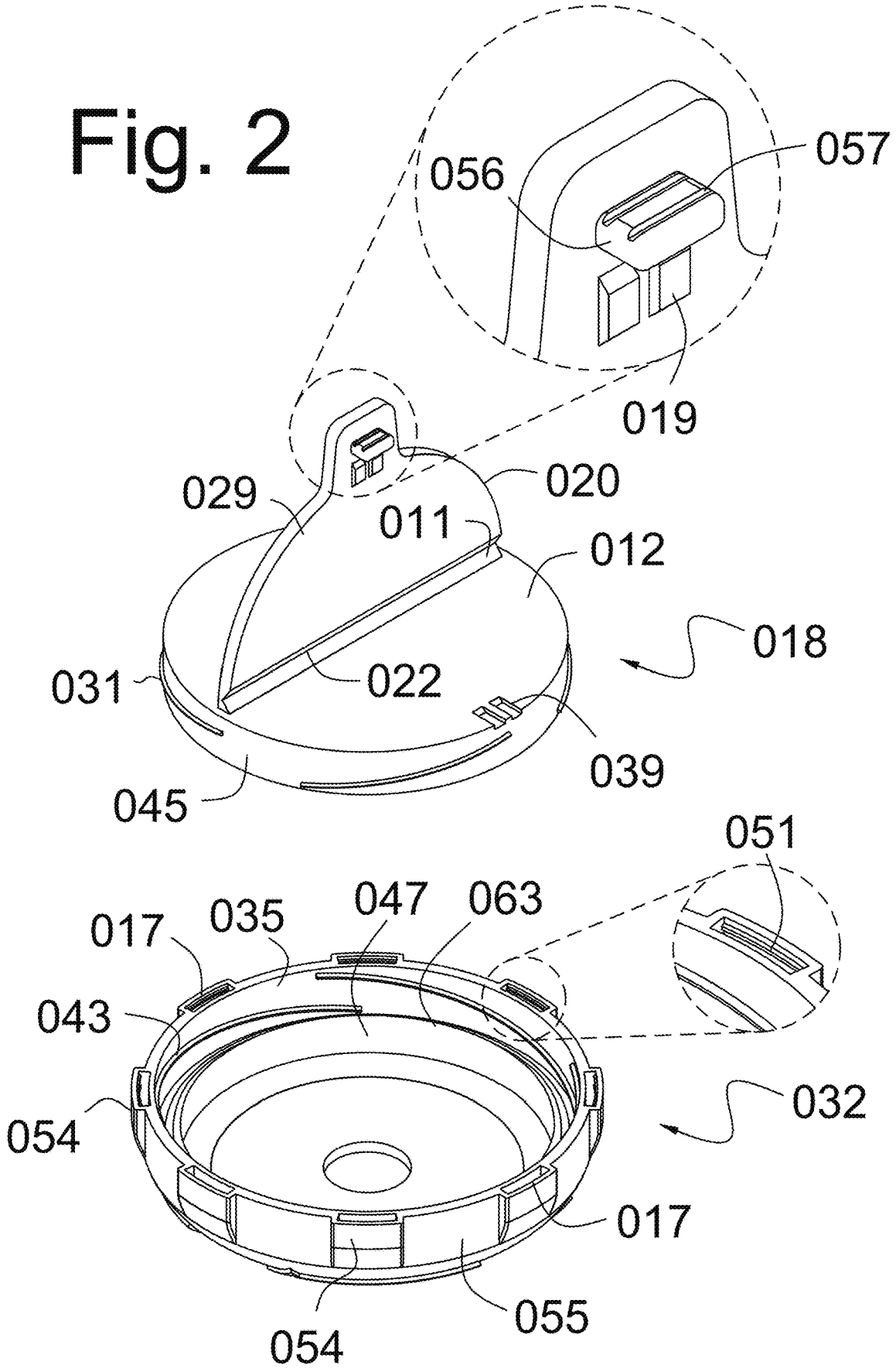
FIG. 2 is an isometric bottom view of the deodorant dispenser with removed cap separated by moving the cap translationally downwards away from the applicator and with a grasping handle in the use position attached to the base.

As illustrated in FIG. 2, base 12 comprises a cylindrical side wall 45 which includes threads 31 on the radially outer surface of side wall 45. Thread 31 is configured to mate with a mating thread 43, located on the radially inside surface 35 of a cap side wall 47 of cap 32.

Cap 32 further comprises an annular sidewall 47 (diagrammatically shown in FIG. 7) positioned radially inward with respect to cap side wall 47 (FIG. 2). Referring to FIG. 2, when cap 32 is tightly screwed into applicator 18, top surface 63 of annular sidewall 47 and bottom surface 65 (FIG. 6) of side wall 45 sealingly contact each other. More particularly, when cap 32 is screwed onto applicator 18, referring back to FIG. 7, top surface 63 advances in the direction of arrow 67, from the position shown in solid lines, toward bottom surface 65 of annular sidewall 47, to the position shown in dashed lines, to provide engagement between the two surfaces 63 and 65. This provides for sealing the contents of the inventive container.

More particularly, in accordance with one embodiment of the present invention, the slanted surface 70 of wedge 68 may be driven against the corner 66 of surface 65. In this case, the result is slight deformation of corner 66 and the confirmation of corner 66 to slanted surface 70 which assures a high-quality seal. This results in very effective sealingly securing cap 32 on applicator 18.

In accordance with the present invention, cap 32 has eight securing positions. That is, when cap 32 is to be screwed in all the way, it can be positioned in eight different ways relative to applicator 18 and handle 20, as will be detailed below in connection with the description of FIG. 3.

Referring to FIG. 2, handle 20 comprises a mounting hinge base member 11 and rigid gripping portion 29. Handle 20 further comprises a living hinge 22, which connects the mounting member 11 to the rigid gripping portion 29. Mounting hinge base member 11 is attached to the underside of base 12 by a heat weld or any other suitable means. Living hinge 22 allows rigid gripping portion 29 to swivel out from a position lying flat against base 12 (FIG. 3), to a position roughly perpendicular or nearly perpendicular to the bottom surface of base 12. This provides for convenient gripping during use. After use or while it is, for example, inside a consumer package, rigid gripping portion 29 may positioned parallel to the bottom surface of base 12.

When it is desired to use the deodorant dispenser, the user can rotate handle 20 away from base 12, such that handle 20 is substantially perpendicular to the base 12, allowing the user to grasp the handle 20 and use the deodorant applicator 18. After use, it may be rotated back to the storage position illustrated in FIG. 3.

Referring back to FIG. 2, rigid gripping portion 29 comprises a prong 56 used to lock gripping rigid gripping portion 29 in the storage position (FIG. 3) by being snapped into one of the eight sockets 54 (FIG. 2). Rigid gripping portion 29 further comprises studs 19 configured to be positioned inside pockets 39 of the base 12 when rigid gripping portion 29 is in storage position. Studs 19 coupled with pockets 39 provide a fictional gripping surface to more securely hold rigid gripping portion 29 when rigid gripping portion 29 is in the storage position.

Figure 3:
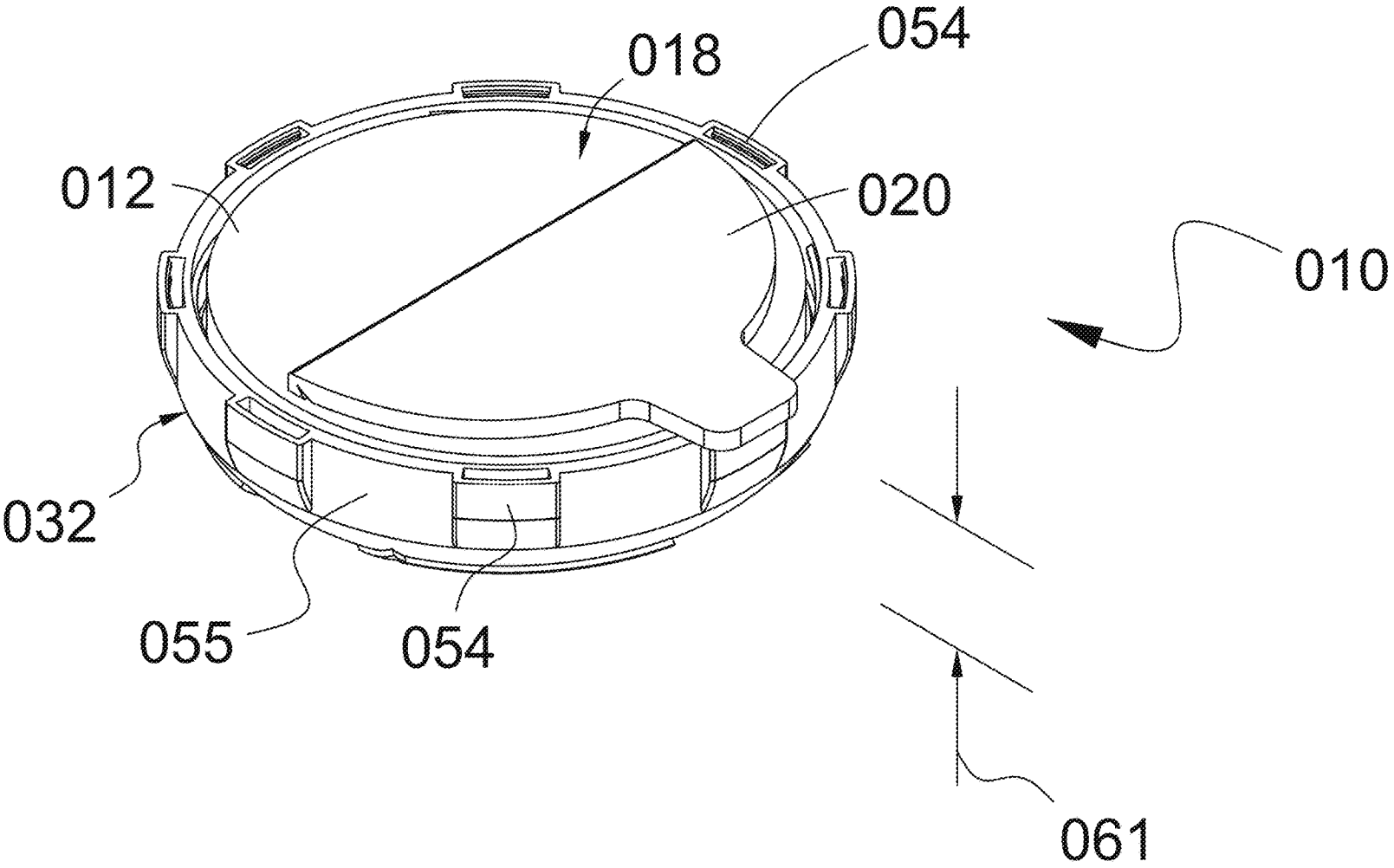
FIG. 3 is an isometric bottom view of the deodorant dispenser closed with a cap and with a handle in the storage position attached to the base.

Referring to FIG. 3, an isometric bottom view of the deodorant dispenser 10 with a cap 32 secured in position closing dispenser 10 is illustrated. Handle 20 in the storage position is illustrated. After deodorant 10 is manufactured and cap 32 is tightly screwed into the applicator 18, handle 20 is folded to the position illustrated. When handle 20 is in the storage position, deodorant dispenser 10 may be packaged in a flat envelope like container. One of the sockets 54 receives the prong 56 of handle 20 when handle 20 is in the storage position. Depending on how the user engages cap 32 and applicator 18, one of the sockets 54 will be positioned to receive the prong 56 when cap 32 is tightly secured on the applicator 18. Each socket 54 can be positioned to receive the prong 56.

Sockets 54 contain indents 51 best seen in FIG. 2 which when coupled with notches 57 of the prong 56 secure handle 20 in storage position. Sockets 54 protrude beyond cylindrical wall 55 thus forming gripping parts which allow the user to more easily dislodge cap 32 from applicator 18.

The thickness 61 (FIG. 3) of the outer surfaces of the deodorant dispenser with closed cap 32 and handle 20 in the storage position may vary and be in the range between 5 mm and 30 mm. More preferably thickness 61 is ranging between 5 mm and 25 mm. Most preferably, the thickness 61 is ranging between 8 mm and 12 mm.

Figure 4:
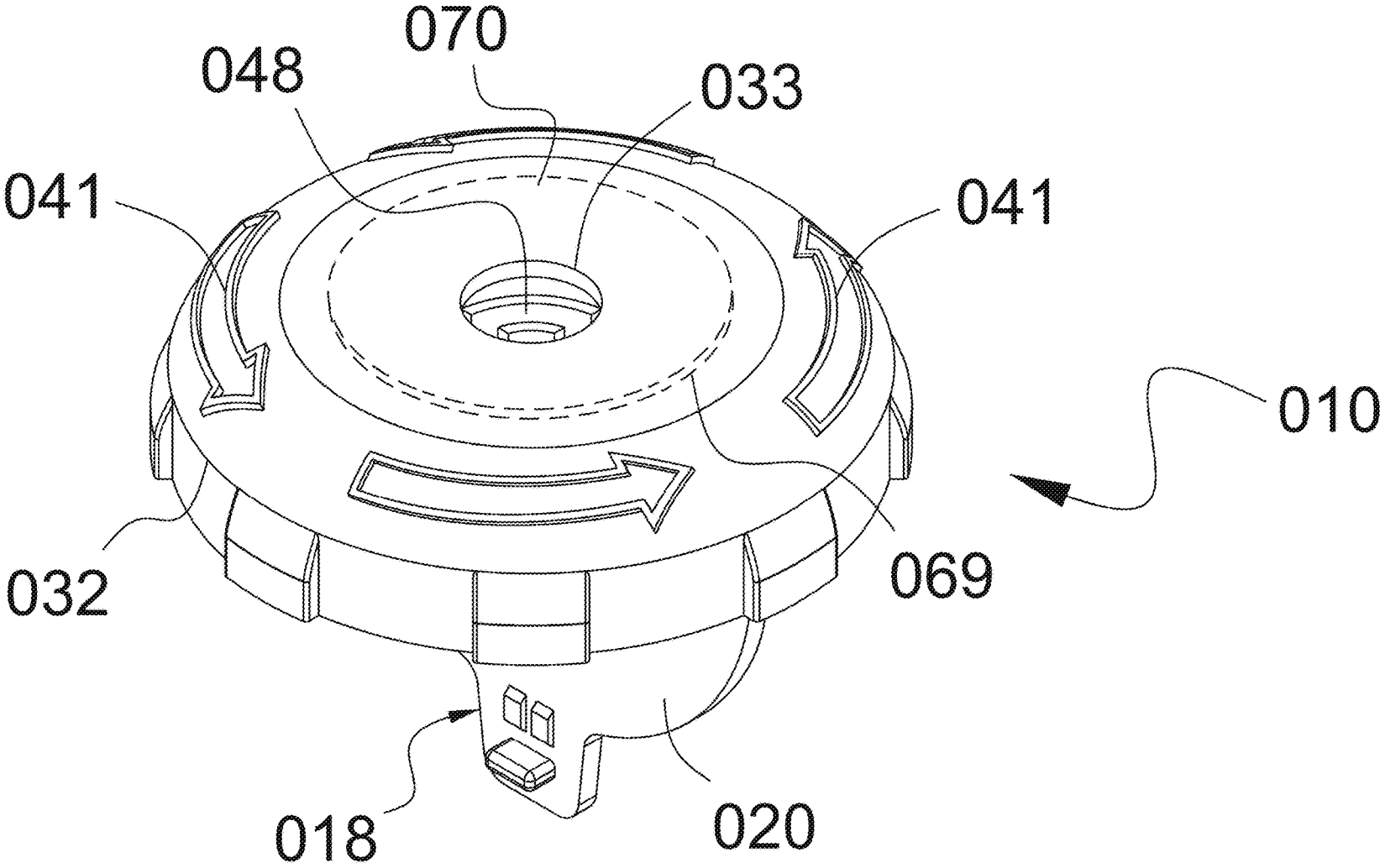
FIG. 4 is an isometric top view of the deodorant dispenser closed with a cap and with a handle in the use position attached to the base.

Referring to FIG. 4, an isometric top view of deodorant dispenser 10 with cap 32 screwed into the applicator 18 and handle 20 in the gripping position is illustrated. Cap 32 has arrows 41 which illustrate, to the user, the direction in which cap 32 is rotated to dislodge cap 32 from applicator 18. When deodorant dispenser 10 is manufactured, cap 32 is screwed into the applicator 18. After closure of the applicator by cap 32, solidifying liquid or gel material to be applied 49 (FIG. 5) is filled, while still liquid, into internal volume 48 through a hole 33 in cap 32. Once internal volume is sufficiently filled with the liquid or gel material to be applied, a self-adhesive sticker 69 (FIG. 4) shown in dashed lines is attached to surface 70, sealing the material in the inventive dispenser 10. Sticker 69 is made, for example, of plastic or paper, and has glue on the side that engages surface 70 which results in sealing hole 33.

Figure 5:
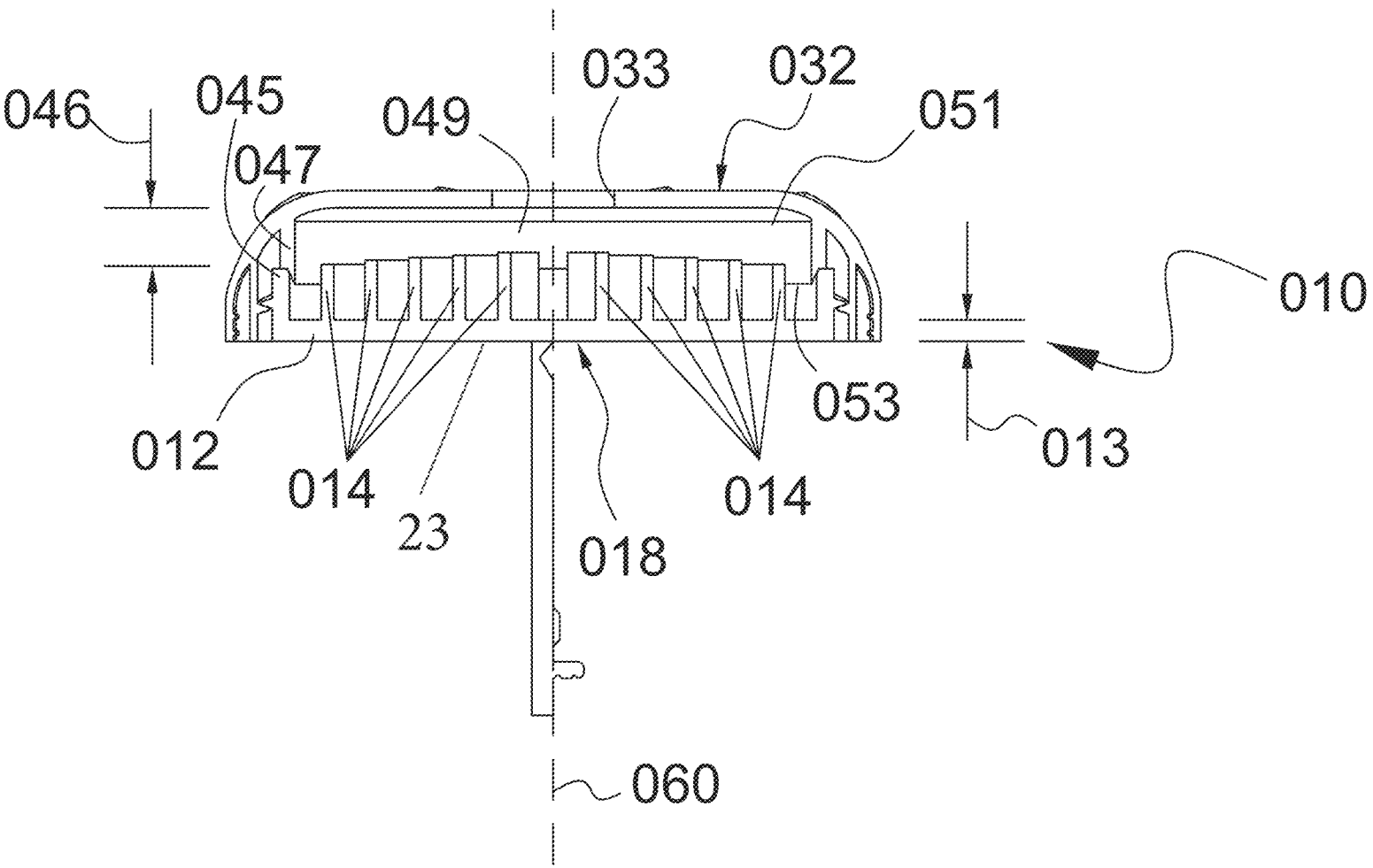
FIG. 5 is a cross sectional view of the deodorant dispenser closed with a cap and with a handle in the use position attached to the base.

Material to be applied 49 is best seen in FIG. 5, where a cross-sectional view of the deodorant dispenser with a closed cap 32 and handle 20 in gripping position is illustrated. As is illustrated, arcuate walls 14 are perpendicularly oriented with respect to and attached to the base 12. Liquid or gel material to be applied is affixed to the base 12, radially inner surface of side wall 45 and arcuate walls 14.

The height of arcuate walls 14 increases as the radius decreases. That is arcuate walls 14 positioned closer to the line 60 have greater height than arcuate walls positioned further from the line 60. In accordance with the present invention, heights of the arcuate walls may vary between 30% and 80% of the height of the space between the top and the bottom of the inner volume. More preferably heights of the arcuate walls may vary between 35% and 70% of the height of the space between the top and the bottom of the inner volume. Most preferably, heights of the arcuate walls may vary between 45% and 60% of the height of the space between the top and the bottom of the inner volume.

Figure 6:
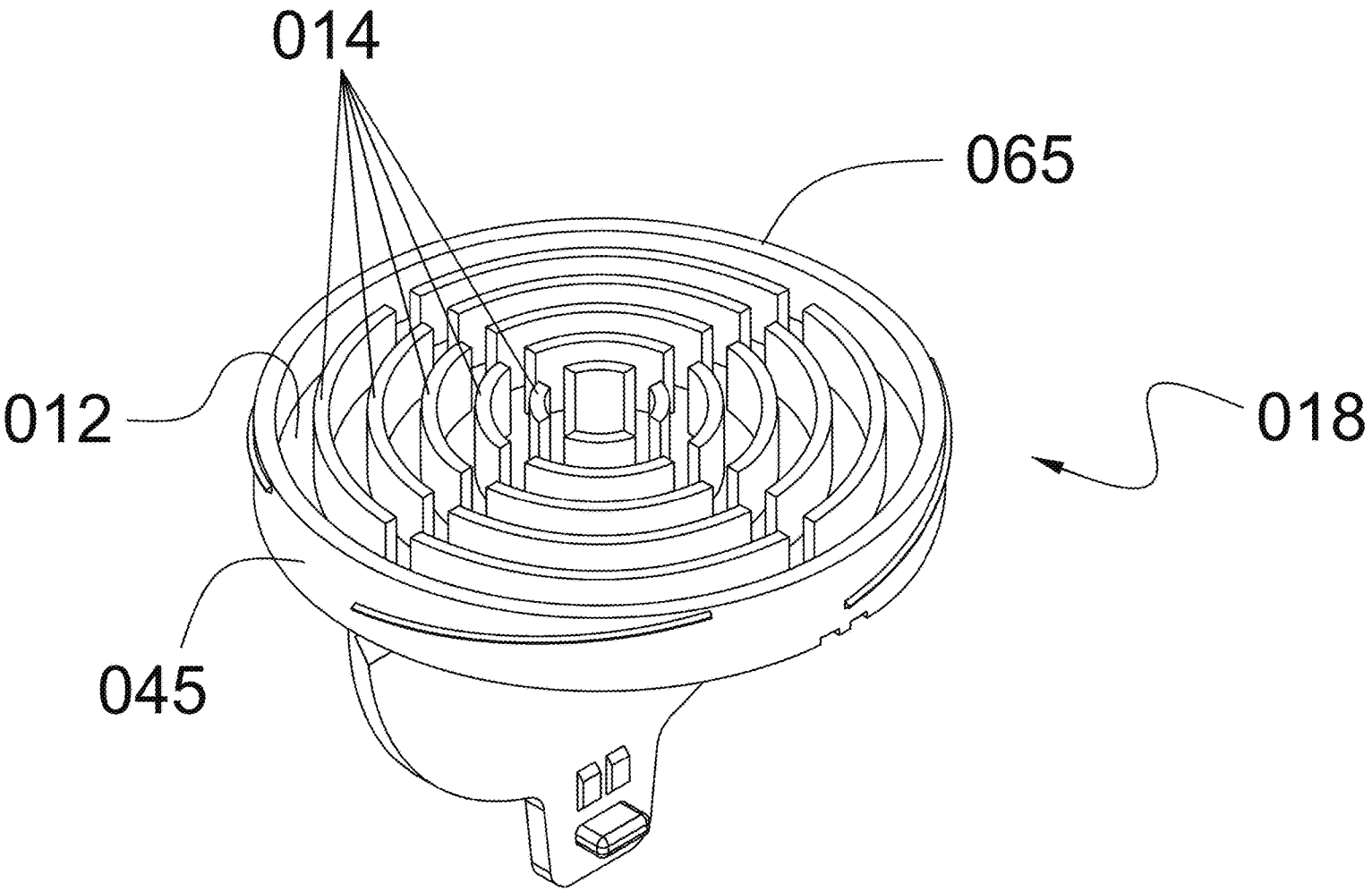
FIG. 6 is a isometric view of the applicator without a cap and with a handle in the use position attached to the base.
Figure 7:
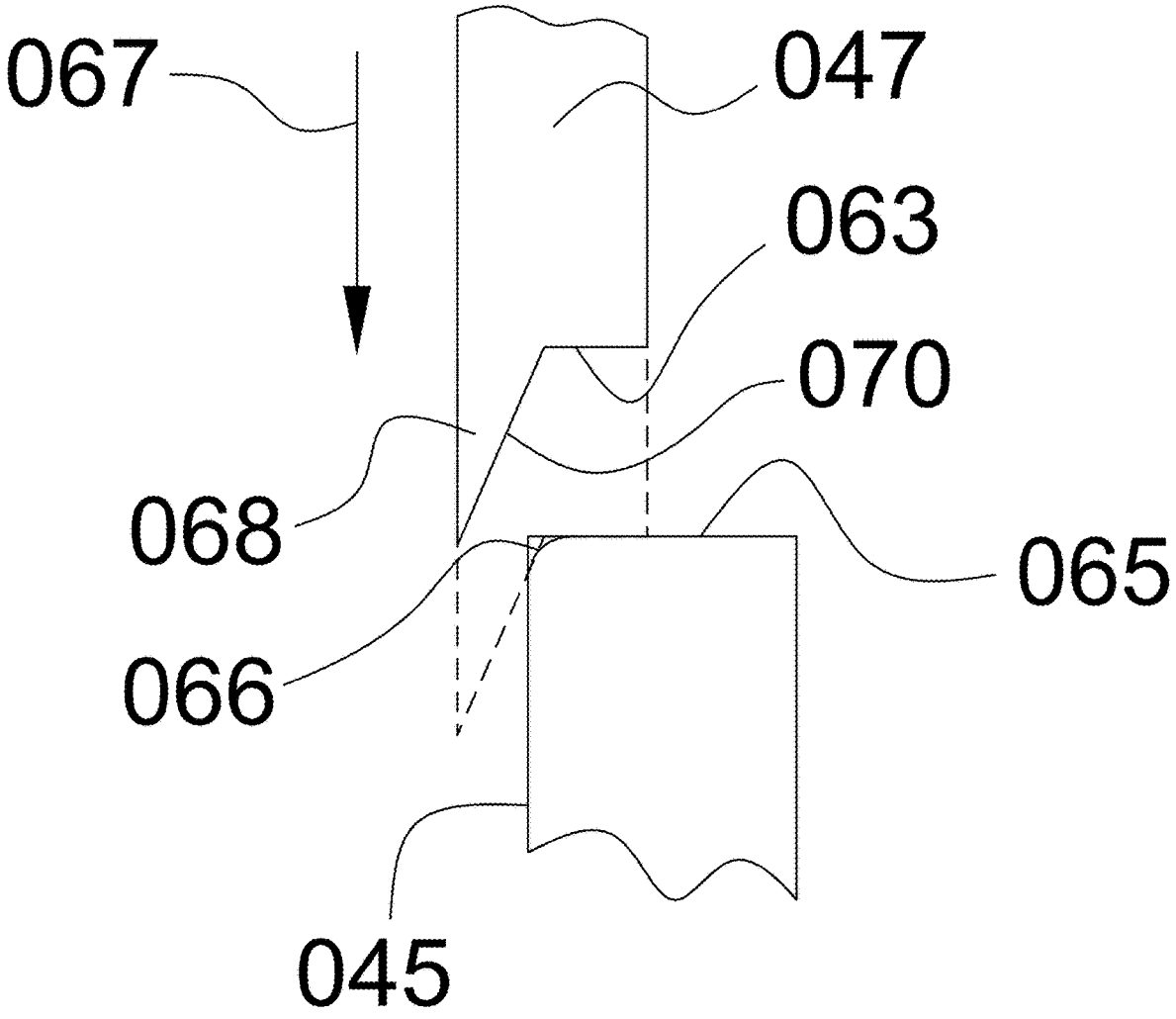
FIG. 7 is a diagrammatic view showing the seal between cap and deodorant dispenser.

An isometric top view of the applicator 18 is illustrated in FIG. 6 where the shape of the arcuate walls 14 can be better understood. Arcuate walls 14 are formed by dividing a ring into a four equal size arcs. The number of rings divided by equal size segments can vary and be, for example, between 1 and 20 or any other number rings that will provide substantial surface area to affix the material to be applied 14 and prevent it from detaching while deodorant dispenser 10 is being used or stored. In accordance with the preferred embodiment, there are five raised rings and each ring is divided into four segments of equal length forming arcuate walls 14. The thickness of the arcuate walls 14 may vary and be in the range, for example, 0.1-2 mm. More preferably, the thickness of the arcuate walls 14 is ranging between 0.1 mm and 1 mm. However, these dimensions are not very critical.

Arcuate walls 14 are shaped and spaced in such a way that the material to be applied 14, in either gel or solid form, can be affixed to the applicator 18 with the deodorant engaging arcuate walls 14, top surface of base 12, and sidewall 45 as an adherence surface. Radius of the arcuate walls 14 may vary and increases by equal increments in order to radially uniformly distribute rings on the surface of the base 12 as illustrated in FIG. 6. In accordance with the particular embodiment, the diameter of the smallest arcuate wall 14 is 7.1 mm and increases by 6.7 mm increments. That is the radii of the arcuate walls from smallest to largest are 7.1 mm, 13.8 mm, 20.5 mm, 27.2 mm, and 33.9 mm respectively, in accordance with the preferred embodiment. However, the same is not critical.

The manufacturing of the single-use deodorant applicator 2 is done by injecting plastic into a mold. Alternatively, the desired member may be made by blow forming and die cutting a sheet of plastic. Multiple members may be formed simultaneously across the width of a plastic sheet web in a continuous blow forming process, thus allowing for mass production. Further, applicator 2 may be made of polypropylene or other materials having characteristics similar to polypropylene.

While the above description of the embodiments focuses on deodorant, other personal hygiene or topical products may be used as well. For example, personal hygiene or topical products such as anti-perspirants, sunscreens, lip balm, fragrance, pain-relievers such as IcyHot.RTM™, anti-chafing balm such as Glide.RTM™, etc. may be used.

In accordance with the embodiment of the invention illustrated in FIGS. 8-10, the locking of the handle in the storage position is maintained in position by a pair of snap engagement surfaces as will be discussed in detail below. Referring to FIG. 9, in the present embodiment, when handle 120 is in the storage position, where it bears against the bottom of the applicator base 112, handle 120 is held in that position (the position illustrated in FIG. 9), by a pair of circumferentially extending engagement members 171. Engagement members 171 bear circumferentially extending nibs 176 which extend towards each other so that the distance between them is slightly less than the width of tab 179 on handle 120, thus allowing handle 120 to flexibly be driven into the slot where it is retained by circumferentially extending nibs 176. This has the advantage of assuring alignment during manufacture as compared to the previous embodiment, which relied upon being in the proper radial position with respect to the base during the filling operation. Also, the tolerances are more forgiving because there is no prong that needs to be aligned with a socket.

Figure 9:
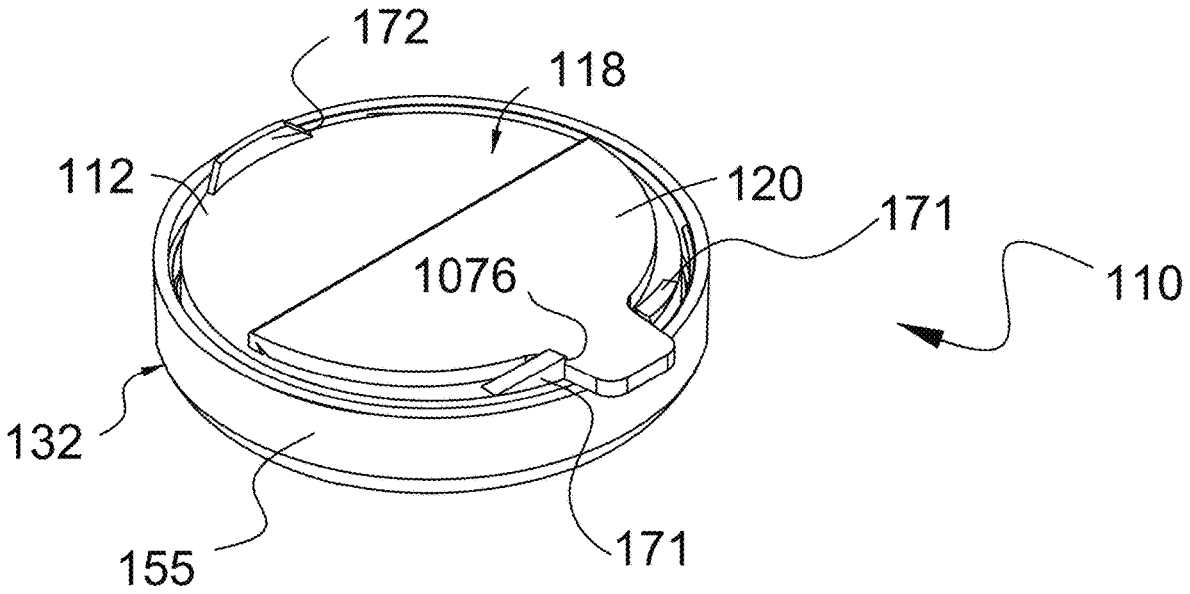
FIG. 9 is an isometric view from the bottom of the inventive deodorant dispenser in the closed position with its cap in place and with a handle in the storage position attached to the base.
Figure 10:
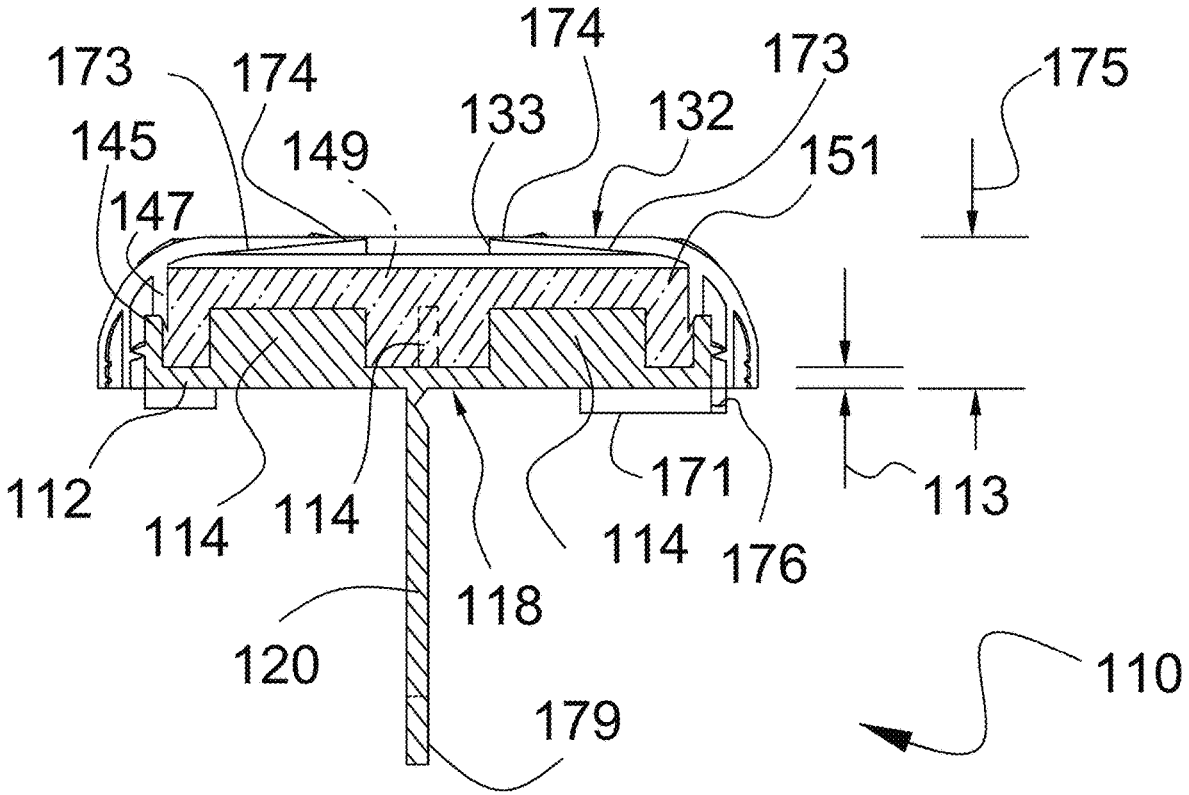
FIG. 10 is an alternate embodiment of a cross sectional view of the deodorant dispenser with the cap closing the deodorant containing compartment and with the handle in the use position attached to the base.
Figure 11:
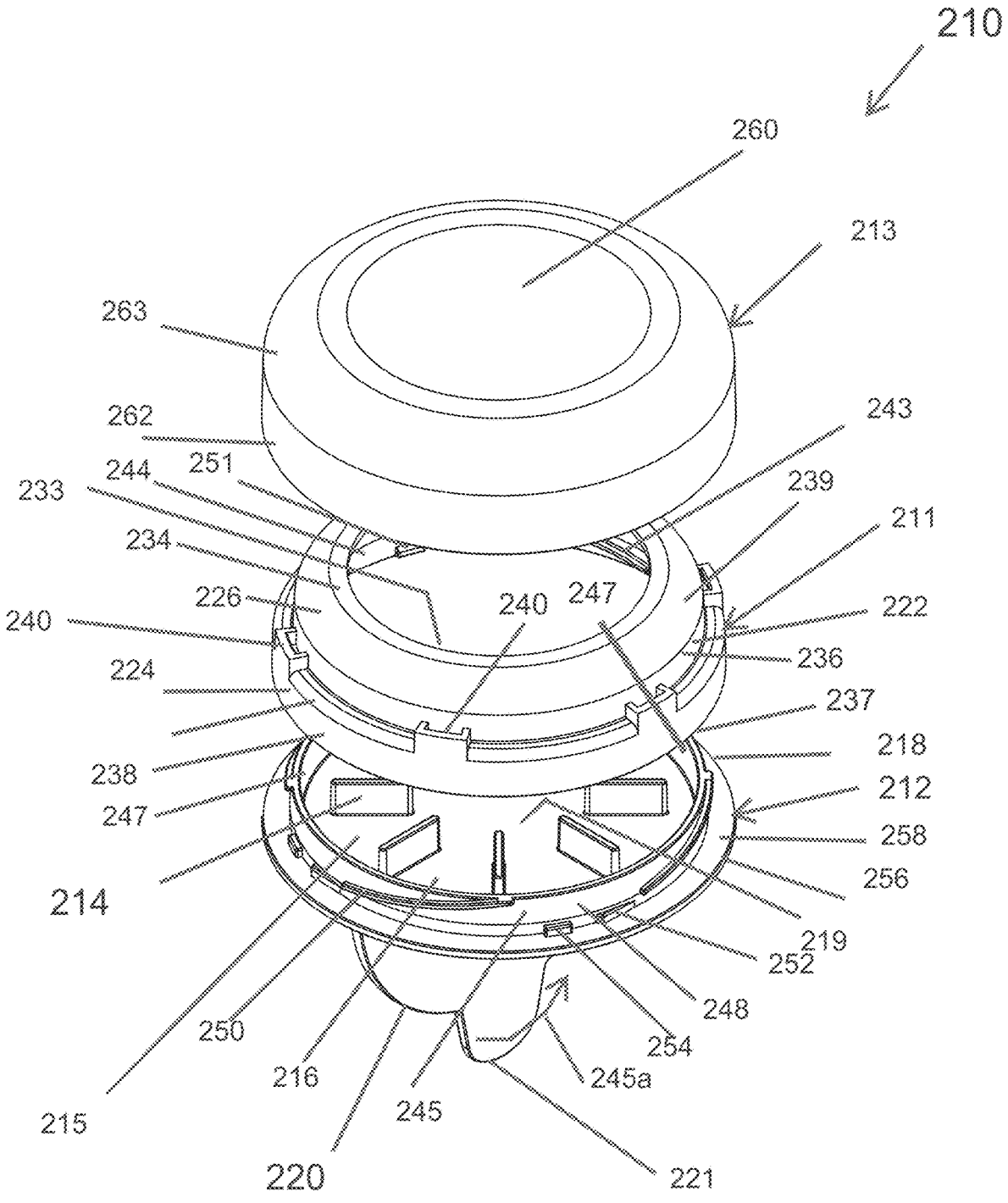
FIG. 11 is an exploded view of a particularly preferred embodiment of the inventive dispenser.

In addition to the use of circumferentially extending engagement members 171 and circumferentially extending nibs 176 that keep handle 120 in place when handle 120 is in the storage position (FIG. 9), as compared to the use position illustrated in FIG. 10, in order to ensure the freshness of the deodorant or other material, such as lip balm, moisturizer, or the like), the inventive dispenser 110 features raised radial members 114 which define radial channels 115. Radial members 114, disposed on the applicator base 112 of the deodorant applicator 110, take the form of raised radial members 114 (FIG. 8). More particularly, in accordance with this embodiment of the invention, the raised radial members 114 have a straight configuration and are oriented radially, which promotes the flow of liquified deodorant material 149 (FIG. 10), when the molten material is poured into applicator/container 110 through hole 133 in cap 132 of inventive deodorant dispenser 110. During filling, the molten material pours down through hole 133 and flows outward radially toward the radially inner surface of sidewall 145 of inventive deodorant or other material dispenser 110.

The use of radially oriented raised radial members 114 combats the tendency of material being filled into the dispenser of the previous embodiments to be slowed down by the obstructing effect of circumferential material retaining extensions of the prior embodiments. The flow was somewhat slowed during the filling process on account of the arcuate walls blocking the flow of liquified deodorant material towards the inner surface of the sidewall of the deodorant dispenser. This decline in flow rate results in solidification before the deodorant material fully fills the deodorant dispenser.

In accordance with the preferred embodiment of the invention, flow is promoted by radially oriented raised deodorant retaining raised radial members 114 (FIG. 10), which allow flow of material therebetween, thus speeding up the flow and assuring that the deodorant dispenser 110 will be filled more evenly. In addition, the increase in deodorant material 149 (higher capacity is also possible because of the radial structure, as discussed below), being poured into the deodorant dispenser 110 at a quicker rate results in overall thermal energy, i.e., a higher temperature, in the liquified deodorant material 149 being at a higher value, which further impedes solidification and promotes flow. In other words, the liquified deodorant material 149 is maintained at a higher temperature during filling because more material is flowing in and because it is flowing in more quickly toward the edges of the container.

As alluded to above, because of the improved flow of material, it is also possible to increase the size of the deodorant dispenser 110. For example, one can fill a container where the height 175 of the container cap 132 is 12.5 mm and its diameter is 48 mm, corresponding to a material-containing compartment having an approximate height of 11 millimeters and a diameter of 40 millimeters. As a result, more of the liquified material 149 may be poured into the container, thus increasing the value of the product.

Figure 8:
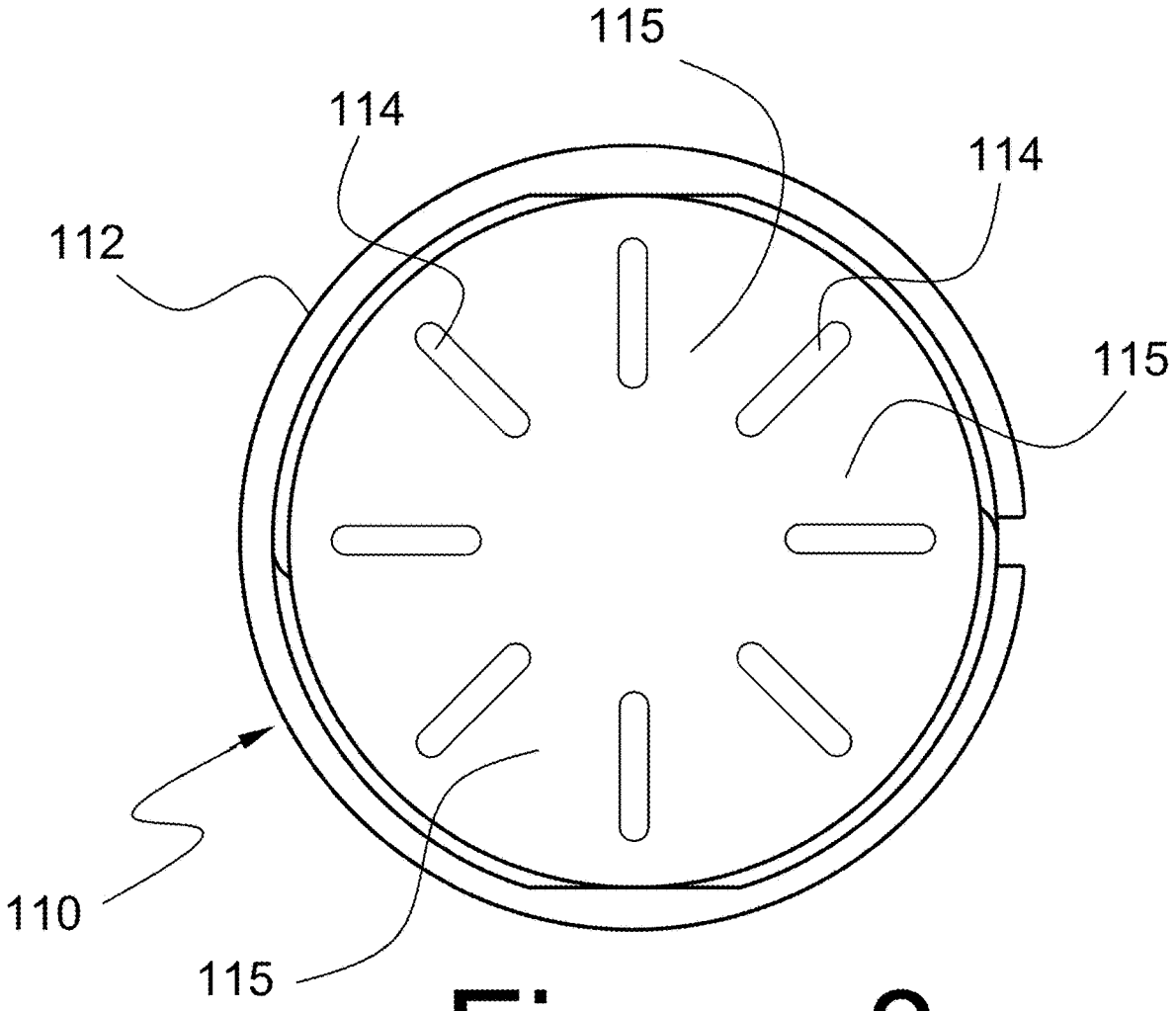
FIG. 8 is a top view of an alternate embodiment of the invention showing the deodorant receiving surfaces.

Referring to FIG. 9, yet another difference in the preferred embodiment of FIGS. 8-10 is the provision of a support member 172. Support member 172 allows the deodorant dispenser 110 to sit flat on a surface when the handle 120 is in the storage position illustrated in FIG. 9. A further improvement in the preferred embodiment of FIGS. 8-10 is the removal of the sockets on the cap 132, which is a material savings. The loss of extra grip is not viewed as significant.

Referring to FIG. 10, finally yet a further improvement in the preferred embodiment is the provision of a tapered thickness in the top surface of the cap 132. More critically, as material is flowing through the hole 133 in cap 132 during filling of the deodorant dispenser 110, which is closed during the filling process (i.e., the cap 132 is screwed down tightly onto the applicator base (112 FIG. 9)), that holds the deodorant material 149, the air in deodorant dispenser 110 tends to be driven outward by the liquified deodorant material 149. In practice, it was found that air bubbles formed at the top of the deodorant dispenser against the inner top surface of the cap 132. By providing for a cap 132 with an inner top surface which is higher in the center than it is at the sides, the small difference in height promotes the migration of bubbles toward the center of the cap 132 allowing air to escape through the opening in the cap 132, allowing a more complete filling of the inventive applicator. In practice, it has been found that a top member having a thickness of 0.635 mm in the center 174 and a thickness of 1.7 mm closer to the circumference 173 provides a sufficient slope to achieve the migration of air bubbles toward the center.

In accordance with the embodiment of the invention illustrated in FIGS. 11-24, a dispenser 210 comprises an applicator 212, a fill frame 211, and a cover 213. Fill frame 211 and cover 213 mate with and lock into each other and together form a cap 232 (shown in FIG. 18). Cap 232 and applicator 212 form a container having an internal volume 283 (FIG. 20) for containing a material 205 (FIG. 22, 24) to be dispensed, such as deodorant.

The material 205 being applied by dispenser 210 is contained within dispenser 210, having been deposited therein as is detailed below. The applicator 212 comprises a base 218 which functions as a foundation upon which the rest of the device is constructed and a handle 220 attached to applicator base 218. Handle 220 has a gripping tab 221, by which the inventive dispenser 210 may be grasped using the thumb and curled index finger during use applying, for example, deodorant to the skin of the user. Tab 221 can include a hole 223 for a carabiner or other connector. In accordance with the present invention, a half-disc-shaped gripping portion 225 of handle 220 and base 218 (FIG. 20) can, preferably, be manufactured as a single piece together with the living hinge 280 which joins them, for example by injection molding. In the event of such a single piece injection molding, such molding is carried out with the orientation illustrated in FIG. 20. Alternatively, handle 220 may be manufactured as a separate part and then secured to the underside 270 (FIG. 14) of applicator base 218.

Referring back to FIG. 11, base 218 has a sidewall 245 oriented perpendicular to the base surface 219 providing a boundary for encircling and holding the material 205. Circular sidewall 245 has an inner surface 247 and an outer surface 248. Outer surface 248 of sidewall 245 includes threads 250 (which mate with mating threads 243), a click member 252 and a stop 254. Any number of click members can be used. While four sets of click members may be used, for example one for each of the four sets of mating threads 250 and 243, one is sufficient. Likewise, the number of threads can vary, or a single thread will also work well. In accordance with the preferred embodiment, a single click member 252 is used.

Material supporting applicator surface 219 includes raised radial members 214 which are positioned perpendicular to the applicator surface 219 and oriented radially (for example, as illustrated, eight raised radial elements are shown, however the number can vary, more or less than what is shown, such as two, four, six, ten, or twelve). Raised radial members 214 serve to fixedly support the material 205 (for example deodorant or lip balm). At the same time, raised radial members 214 define radial channels for the molten, for example deodorant, material to flow when the wax like material of the product is filled into the inventive dispenser 210 into the center of the spoke-like pattern defined by radial members 214. Base 218 extends outward past sidewall 245 and includes a shoulder 256 which provides a contact surface 258 for bottom 231 of combination cap 232 (FIG. 12), which performs the function of improving the seal of material inside the inventive dispenser 210, something which may be of particular importance should environmental temperatures be elevated.

Fill frame 211 comprises an annular member 222 having a circular opening 233 at a top flat portion 234, and at bottom 237. Fill frame 211 includes a cylindrical sidewall formed by a circumferential ridge 238 on a bottom portion 224 of fill frame 211. Circumferential ridge 238 has sockets 240 that mate with internal prongs 264 (FIG. 16) (six sockets are shown, however more or less may be used such as two, four, eight, or ten). Circumferential ridge 238 further comprises an inner surface 244 which has mating threads 243 that mate with threads 250. Fill frame 211 includes a rounded upper portion 226 and has a cylindrical sidewall 236, an upper sidewall portion with a rounded edge 239 (which may define a portion of the sphere), and a top surface 234. Top surface 234 defines a circular central opening 233 which allows for filling the applicator with material.

Figure 16:
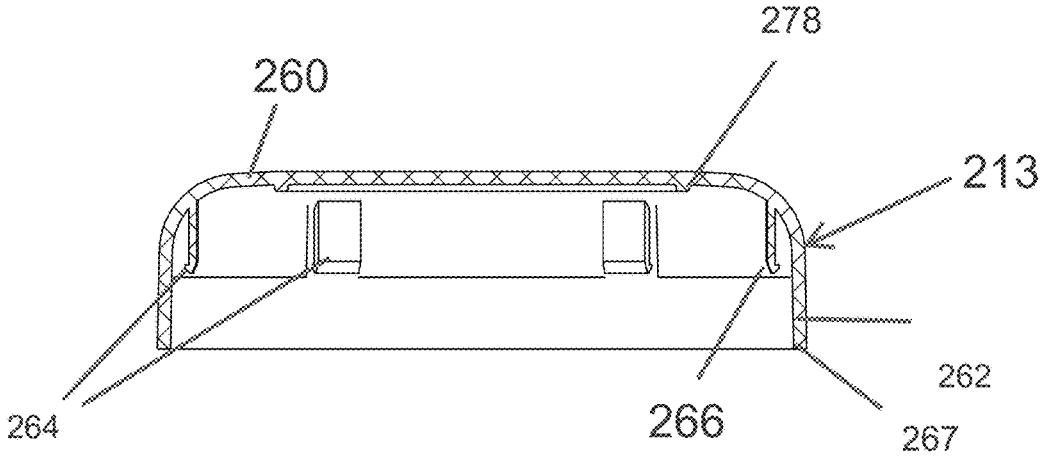
FIG. 16 shows a cross sectional side view of the cover.

Cover 213 is molded with multiple parts, comprising a closed top 260, and a circumferential sidewall 262, with a rounded edge 263 extending between top 260 and circumferential sidewall 262, as well as internal prongs 264 (FIG. 16).

Figure 12:
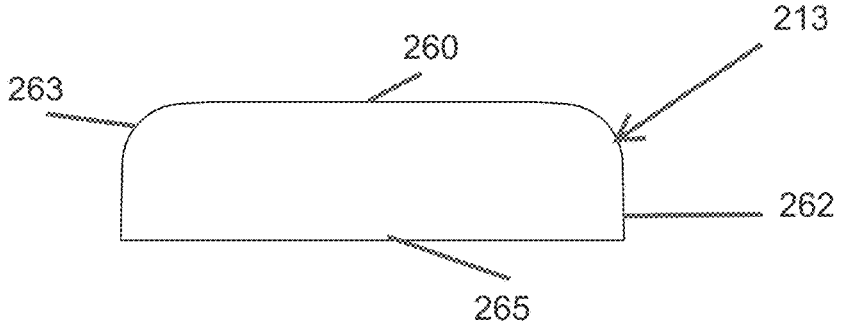
FIG. 12 shows an exterior side view of the cover.

FIG. 12 shows an exterior side view of top 260 which forms the upper part of cover 213.

Figure 13:
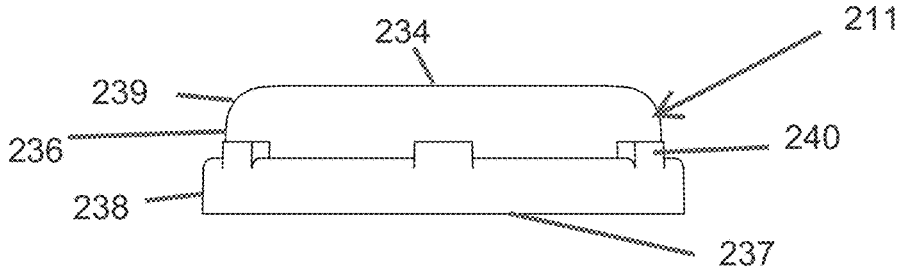
FIG. 13 shows an exterior side view of the fill frame.

FIG. 13 shows an exterior side view of fill frame 211, which forms the lower part of cover 213.

Figure 14:
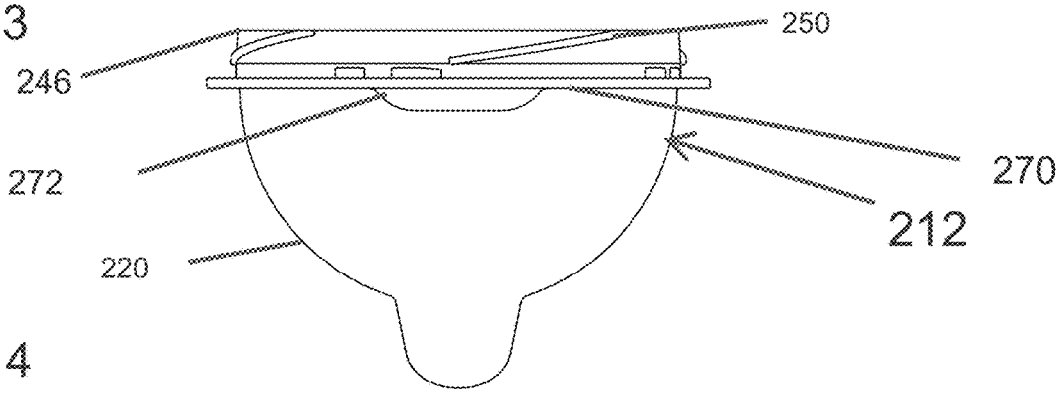
FIG. 14 shows a back side view of the applicator with the handle in an unfolded position.

FIG. 14 shows a first side view of the applicator 212 with the handle 220 in an unfolded position, and without the material to be applied. Support member 272 is positioned on the underside 270 of applicator base 218.

Figure 15:
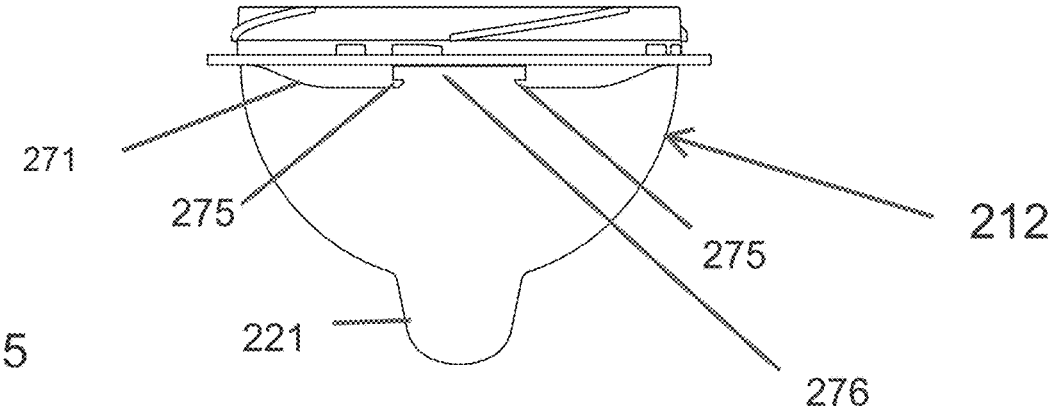
FIG. 15 shows a front view of the applicator with the handle in an unfolded position.

FIG. 15 shows a second opposite side view of the applicator 212 with the handle 220 in an unfolded position. Engagement members 271 are positioned on the underside 270 of applicator base 218. Engagement members 271 engage with tab 221 when the handle 220 is in a folded orientation (FIG. 22). Locking engagement members 271 have teeth 275 that extend a short distance over a gap 276. Gap 276 is dimensioned to accommodate dimensions of the tab 221 when handle 220 is in a folded position, after being moved in the direction of arrow 245*a* in FIG. 11. Teeth 275 on flexible (because of the material of which applicator portion 212 is made) releasably retain the tab 221 within gap 276. Engagement members 271 are substantially the same height as support member 272 (FIG. 20). The heights of engagement members 271 and support member 272 exceed that of the handle when in its folded position. The position of the handle 220 mounted on living hinge 280 can be positioned closer to the base as compared to the extent the engagement members and support member extend out from the base.

Referring back to FIGS. 16-18, FIG. 16 shows a cross section of cover 213. Cover 213 includes a top 260, a circumferential sidewall 262, a raised circular member 278, and internal prongs 264. Circumferential sidewall 262 has a bottom 267. Internal prongs 264 extend downward from the top 260 of cover 213. Internal prongs 264 have prong hooks 266 and align and mate with sockets 240 on the fill frame 211 (FIG. 17), to form the structure illustrated in FIG. 18. Socket 240 has a socket mating hook that locks onto the prong hook 266 of internal prong 264. Interlocked prong and socket closure 228 holds the cap 232 together for at least the duration that the dispenser is to be use. Optionally, a cap that does come apart can be used in an alternate embodiment, and can be used to add additional functionality to the dispenser.

Figure 17:
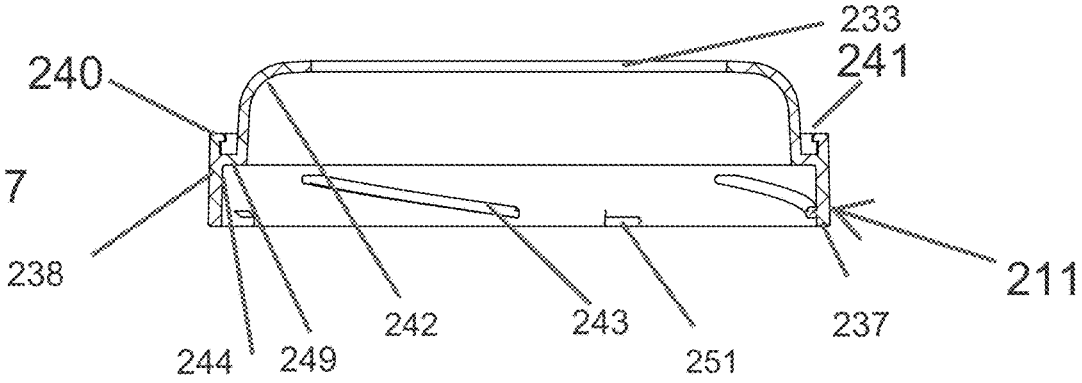
FIG. 17 shows a cross sectional side view of the fill frame.

FIG. 17 shows a cross section of fill frame 211. Fill frame 211 includes circular opening 233, circumferential ridge 238, socket 240, and internal volumetric surface 242. Internal surface 244 of circumferential ridge 238, includes threads 243, and a top 249 of internal surface 244 of circumferential ridge 238. Top 249 of internal surface of circumferential ridge 244 is designed to come in contact with top 246 of sidewall 245 on applicator 212 (FIG. 20).

Circumferential ridge 238 is wider than internal volumetric surface 242 allowing for internal mating threads 243 to mate with threads 250 on applicator 212, and aligning the internal volumetric surface 242 with sidewall 245 (FIG. 20) of applicator 212 and form an internal volume 283 (FIG. 21). Detent tabs 251 are designed to interact with and facilitating the action of click element 252 and stop member 254 on applicator 212. Stop member 254 prevents overscrewing, while click member 252 signals the user that the cover has been sufficiently closed and prevents accidental opening.

Figure 18:
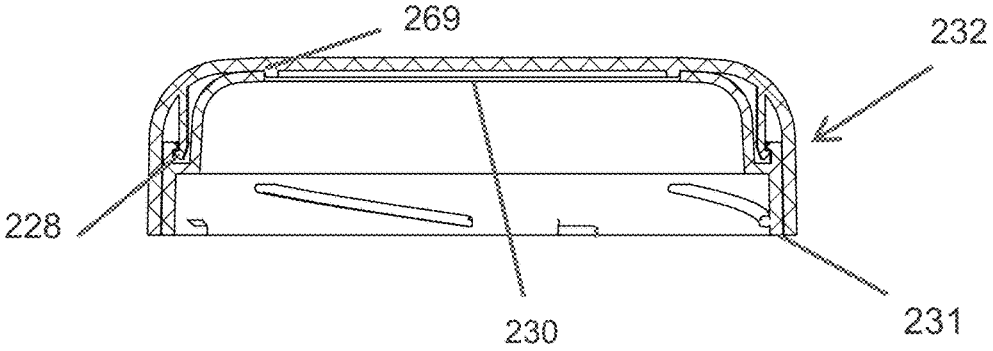
FIG. 18 shows a cross sectional side view of the cap (cover and fill frame combination).

Referring to FIG. 18 showing a cross section of cap 232, cap 232 is formed by the interlocked fill frame 211 and cover 213. These two elements in combination form cap 232. Fill frame 211 fits into cover 213. Internal prongs 264 align and lock with sockets 240 (FIG. 18). Circular opening 233 aligns with and is thus sealed by the raised circular member 278 of cover 213, forming a circular seal 230 and completes the internal volumetric surface of fill frame 211. Combination cap 232 retains the internal structure of fill frame 211, namely internal mating threads 243 and internal volumetric surface 242 now including raised circular member 278.

Internal prongs 264, as alluded to above, enter sockets 240 when the two parts are brought together, and prong hooks 266 lockingly engage with socket mating hooks 241 (FIG. 17), by being structurally permitted to enter and then getting locked in position and being substantially unable to exit the sockets 240. Raised circular member 278 extends internally perpendicular to top 260. Raised circular member 278 aligns with and closes circular opening 233 of fill frame 211 (FIG. 17) forming a seal at circular junction 269 preventing leakage in or out of the dispenser.

Figure 19:
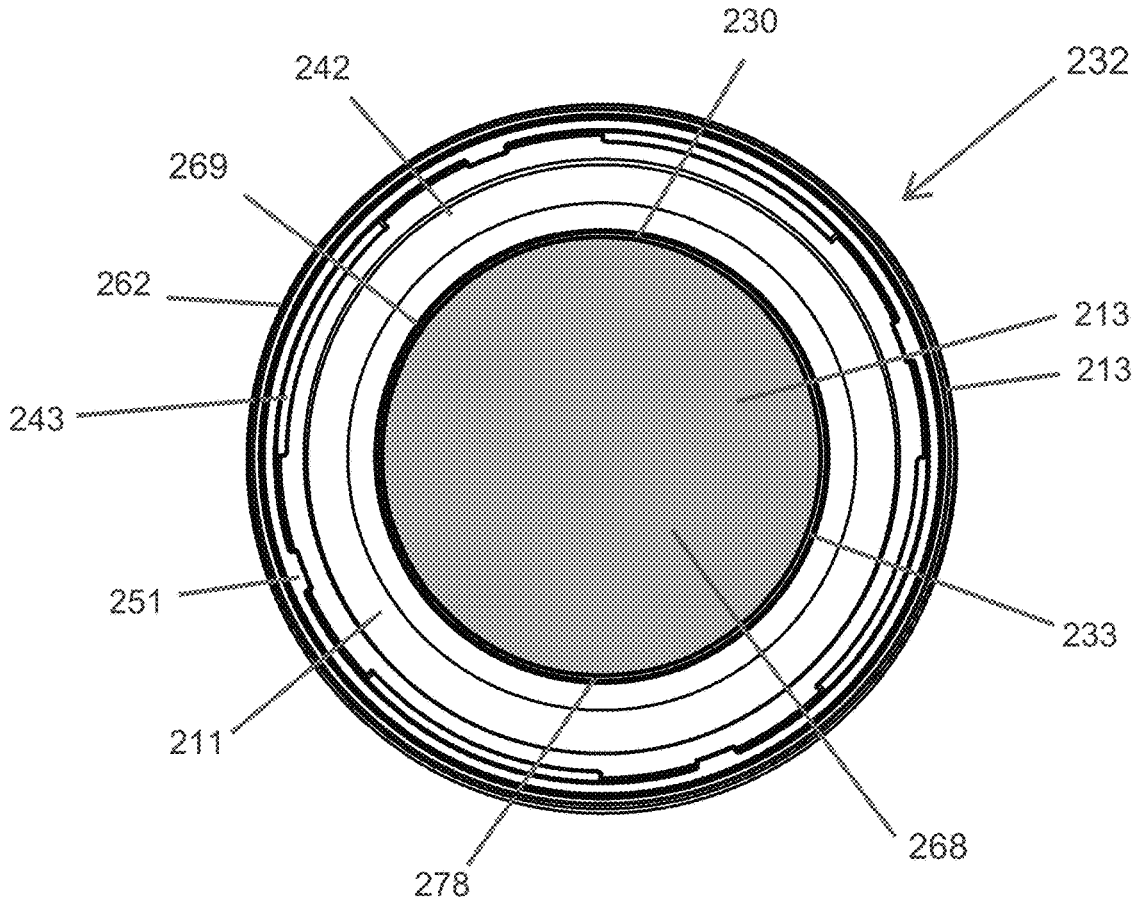
FIG. 19 shows a bottom view of the cap (cover and fill frame combination).

FIG. 19 shows a bottom and internal view of cap 232. Raised circular member 278 of cover 213 aligns with circular opening 233 of fill frame 211 and is substantially continuous with internal volumetric surface 242 of fill frame 211. Combination cap 232 inherits the internal mating threads 243 from the fill frame 211, while closing off the circular opening 233 of fill frame 211, and providing a smooth exterior provided by the circumferential sidewall 262 of cover 213. Internal circumference of circular opening 233 is substantially the same as the external circumference of raised circular member 278.

FIG. 20 shows a cross sectional side view of the applicator 212. Raised radial members 214 extend upward from applicator surface 219 providing support for material 205. Raised radial members 214 are oriented radially which allows for unobstructed flow of liquified material to reach side wall 245. Sidewall 245 extends upward to top 246 of sidewall 245 and is substantially perpendicular to base 218. Handle 220 is disposed across the underside 270 of base 218 and has a living hinge 280 allowing handle 220 to be folded parallel to base 218 (FIG. 22).

FIG. 21 shows a cross sectional side view of the applicator 212 with the combination cap 232 secured to the applicator.

Internal volumetric surface 242 of fill frame 211 in combination with applicator surface 219 and circular top 268 form material receiving and housing volume 283. Material 205 takes the shape and volume substantially that of the lower portion of material volume 283.

Bottom 237 of fill frame 211 and bottom 267 of cover 213 both come in contact with shoulder 256 of applicator 212 and each provide a double seal preventing leakage of air or liquid from coming in or going out of the dispenser unintentionally, while a double seal is preferred, a single seal can work as well.

FIG. 22 shows an enlarged cross sectional side view of the dispenser with the handle folded. Fill frame 211 has two seals that assist in the molding process by preventing the material from leaking or evaporating while cooling in the fill frame, and assists in retaining the shape of the volumetric space in the dispenser. Top of sidewall 246 forms a seal with top 249 of internal surface of circumferential ridge at ridge junction seal 290. Bottom 237 of fill frame 211 form a fill frame seal 292 with shoulder 256.

Bottom 267 of cover 213 can form an additional cover sidewall closure 294 with shoulder 256. Spaces between the fill frame and cover allow for further reduction of plastic in the manufacturing an iteration of the dispenser embodiments described herein.

Figure 23:
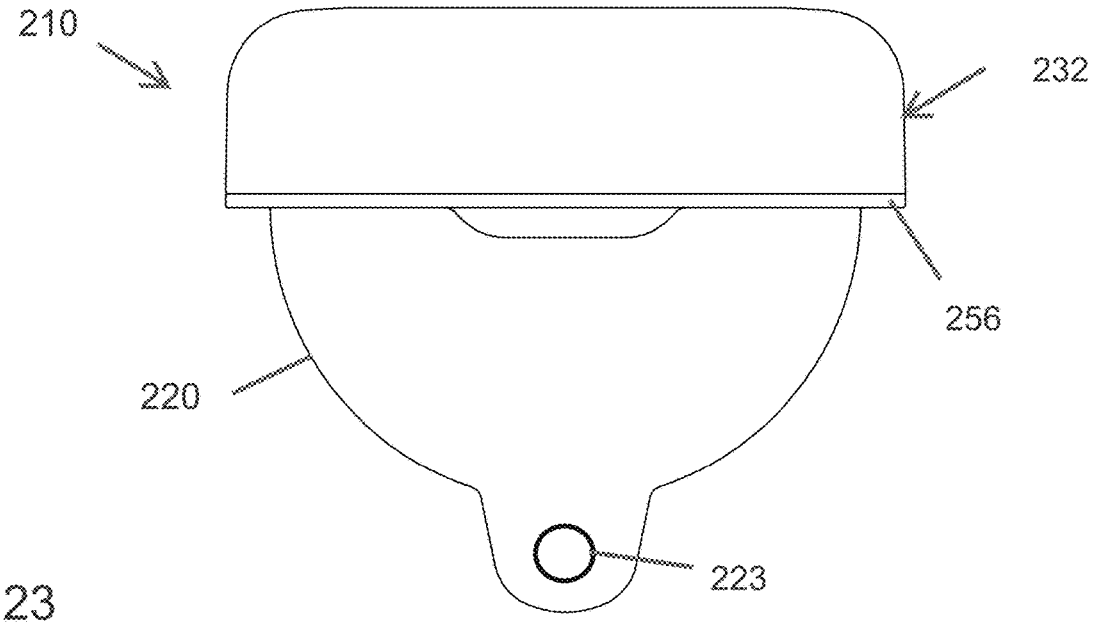
FIG. 23 is an exterior side view of a covered dispenser with an unfolded handle.

FIG. 23 is an exterior side view of a covered dispenser with an unfolded handle.

Figure 24:
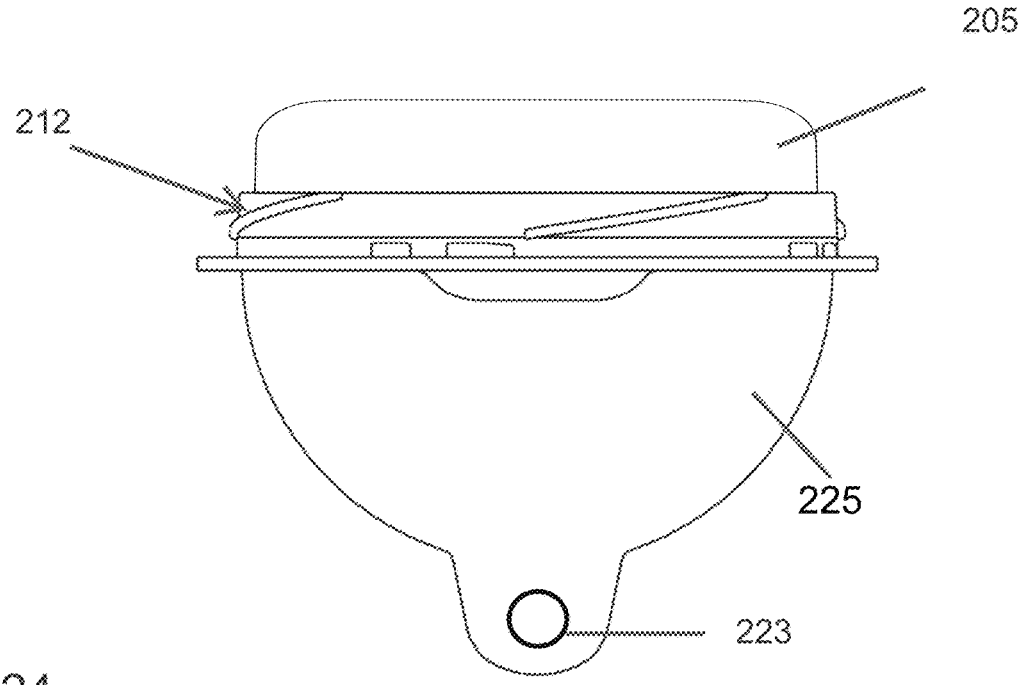
FIG. 24 is a side view of an uncovered and filled dispenser.

FIG. 24 is a side view of a filled and uncovered dispenser.

The fill frame is screwed onto the applicator, with the central opening exposed. Material 205 is heated to a liquid state and poured in to the internal volume through the central opening. More particularly, when it is desired to manufacture product using the inventive dispenser 210, fill frame 211 is positioned on applicator 212 and molten material to be dispensed, for example lip balm or anti-perspirant/deodorant, is poured into the center of the spoke-like configuration of raised radial members 214, flowing to the circumferential sides of the internal volume 283 of dispenser 210. The molten material is unobstructed and guided from the center to the edges by the raised radial members and fills the internal volume. Then cover 213 is then pushed onto and thus secured to the fill frame and thus is combination with the applicator this is achieved by the cap locking into the prongs on the fill frame and closing the central opening, which forms cap 232. Subsequently, once the molten material is cooled, the thus formed two-part cap 232 (FIG. 18) can be unscrewed to expose solidified material 205 secured to applicator 212, for use by an individual who grasps handle 220 and rubs product 205 onto his or her skin.

Fill frame 211 is used to retain and form the liquified material 205 when in its heated and liquid state. As noted above, the film frame 211 screws onto the base 218 and then is filled by hand or machine through opening 220. When cooled, the liquefied material hardens and takes the shape of the portions of the base 212, fill frame 214, and cover 213 that the liquified material comes in contact with and thus assumes the shape of the internal volume of the deodorant dispenser.

Handle 220 can be folded via the living hinge and temporarily secured in place by the engagement members. Since the support member and engagement members have a larger height compared to the folded handle, dispenser 210 can sit flat on a surface without the handle creating a lever which would disturb this ability.

While illustrative embodiments of the invention have been described, it is noted that various modifications will be apparent to those of ordinary skill in the art in view of the above description and drawings. Such modifications are within the scope of the invention which is limited and defined only by the following claims.

The attachment member and mating attachment member can be selected from a variety of options including but not limited to, a prong and socket attachment mechanism, adhesives, hot melt adhesive, ultrasonic welding, hot plate welding, vibration welding, spin welding, infrared welding, solvent bonding, snap fit, thermal bonding, chemical welding, rivets, press fittings, solder, crimping, heat staking, or other suitable attachment mechanisms, screws and bolts, clips and clamps, epoxy, cyanoacrylate, acrylic adhesives, solvent cements, laser welding, plastic welding rods.

What is claimed:

1. A device for receiving a molten product for application to the skin, molding the shape of said product and containing it while it cools and solidifies, and serving as a dispenser for said cooled solidified product comprising:

(a) a base for supporting said product in the solid state, said base having a support surface and an outer peripheral surface;

(b) a fill frame member, having a circular opening for receiving said molten product, and configured to be secured to said base and together with the support surface of said base to define a mold for the receipt of said molten material, said fill frame member having an outer peripheral surface;

(c) a cover member configured to mate with said fill frame member;

(d) locking structure formed on said cover member;

(e) first mating locking structure formed on said fill frame member, said mating locking structure mating with said locking structure when said locking structure is brought into engagement with said mating locking structure, whereby said cover member and said fill frame member together form a cap;

(f) first rotary engagement structure disposed on said outer peripheral surface of the base;

(g) mating rotary engagement structure disposed on an inner peripheral surface of a side wall of said fill frame.

2. A device as in claim 1, further comprising a circumferential sidewall, said circumferential sidewall being secured to said cover member, and said circumferential sidewall having an internal circumferential surface.

3. A device as in claim 1, said support surface of said base further comprising radial members extending substantially perpendicular to said support surface, said radial members defining radial channels for flow of said molten material.

4. A device as in claim 1, said first rotary engagement structure further comprising a screw thread, and said mating rotary engagement structure further comprising a mating screw thread engagement structure.

5. A device as in claim 1, said first rotary engagement structure further comprising bayonets, and said mating rotary engagement structure further comprising a mating bayonet engagement structure.

6. An Apparatus for the application of a personal hygiene or other topically applied substance to the surface of the human body comprising:

(a) a base, comprising:

(i) an applicator portion, said applicator portion having a topically applied substance support surface, said topically applied substance support surface having an outer portion; and (b) a personal hygiene or other topically applied substance secured to the topically applied substance support surface on said applicator portion of said base, said base and said personal hygiene or topically applied substance forming an applicator, said applicator portion defining a support surface and (c) a protective member, defining a closed compartment protecting and housing said personal hygiene or topically applied substance, wherein said protective member further comprises a fill frame having a circular opening for filling and a cover forming a cap for opening the apparatus.

7. An apparatus as in claim 6, wherein the personal hygiene or other topically applied substance has a shape and volume defined by an interior space formed by a combination of said substance support surface, fill frame, and cover.

8. An apparatus as in claim 6, wherein the fill frame further comprises an upper opening and threads on an interior circumferential surface, and said base further comprising threads on an external circumferential surface on said applicator portion, wherein said fill frame is attached to the base for filling, and then the cover is secured to the fill frame, said cover closing the fill frame opening.

9. An apparatus as in claim 6, wherein the fill frame further comprises at least one attachment member, and the cover further comprises at least mating attachment member, wherein said attachment member corresponds and aligns with said mating attachment member, locking said cover to said fill frame, forming said protective member.

10. An apparatus as in claim 6, wherein the cap formed by the fill frame and cover have an attachment member and mating attachment member respectively, and wherein the attachment member and mating attachment member are selected from the group consisting of a prong and socket attachment mechanism, adhesives, hot melt adhesive, ultrasonic welding, hot plate welding, vibration welding, spin welding, infrared welding, solvent bonding, snap fit, thermal bonding, chemical welding, rivets, press fittings, solder, crimping, heat staking, or other suitable attachment mechanisms, screws and bolts, clips and clamps, epoxy, cyanoacrylate, acrylic adhesives, solvent cements, laser welding, plastic welding rods.

11. An apparatus as in claim 6, wherein there are threads on an interior circumferential surface of the fill frame and further comprise a detent tab, and wherein there are threads on an external circumferential surface on said applicator portion further comprise a click member and a stop member, whereas when the fill frame is aligned with the applicator portion and rotated to secure the fill frame to said base, upon completion of attaching said fill frame to said applicator portion, the detent tab passes and interacts with the click member performing an audible click, and whereas when the detent tab comes in contact with and interacts with the stop member further rotation is prevented signaling that the apparatus is securely detachably attached.

12. An apparatus as in claim 6, wherein the base further comprises a shoulder extending circumferentially outward parallel to said applicator portion, wherein the fill frame closes flush with said shoulder, forming a seal substantially preventing air or liquid leakage.

13. An apparatus as in claim 6, wherein the applicator portion further comprises a sidewall having a top portion, in wherein the top portion closes flush with an internal top surface on an internal circumference of the fill frame, forming a seal.

14. An apparatus as in claim 6, said applicator portion further comprising at least one raised member, said raised member being configured to allow the substantially unobstructed flow of molten personal hygiene or topically applied substance radially outwardly toward an outer portion of said topically applied substance support surface, said raised member defining at least a portion of said topically applied substance support surface.

15. An apparatus as in claim 6, wherein the base further comprises a gripping portion, said applicator portion being attached to or formed integrally with a gripping portion.

16. An apparatus as in claim 6, further comprising an engagement member secured to said applicator portion, and wherein a gripping portion comprises a handle pivotally mounted to said applicator portion, said handle comprising a mating engagement member which mates with and may be secured by said engagement member to put a handle in the retracted position.

17. Apparatus as in claim 16, wherein the engagement member further comprises a set of teeth for securing said gripping portion when in the retracted position.

18. Apparatus as in claim 17, wherein said base further comprises a support member, said support member having a height substantially equal to said engagement member.

19. Apparatus as in claim 18, wherein said gripping portion further comprises a tab extending from said gripping portion, and wherein said tab further comprises a hole for accessories.

20. Apparatus as in claim 16, wherein the gripping portion further comprises a living hinge.

21. An apparatus of claim 6, wherein said base portion comprises threads which threadingly engage mating threads on said protective member and further comprises a locking structure whereby said protective member cannot be over-screwed on said threads.

* * * * *